United States Patent [19]

Rymas

[11] Patent Number: 4,671,685

[45] Date of Patent: Jun. 9, 1987

[54] PRINTER WIRE

[75] Inventor: Frank Rymas, Sterling Heights, Mich.

[73] Assignee: GTE Products Corporation, Stamford, Conn.

[21] Appl. No.: 828,098

[22] Filed: Feb. 10, 1986

Related U.S. Application Data

[63] Continuation of Ser. No. 584,847, Jul. 24, 1985, abandoned.

[51] Int. Cl.[4] ..... B41J 3/12; C22C 29/02

[52] U.S. Cl. ..... 400/124; 101/93.05; 75/242

[58] Field of Search ..... 75/242; 400/124; 101/93.05

[56] References Cited

U.S. PATENT DOCUMENTS

| | | | |
|---|---|---|---|
| 3,816,081 | 6/1974 | Hale | 75/242 X |
| 4,145,213 | 3/1979 | Oskarsson | 75/242 X |
| 4,307,966 | 12/1981 | Spencer | 400/124 |

FOREIGN PATENT DOCUMENTS

| | | | |
|---|---|---|---|
| 11802 | 1/1980 | Japan | 400/124 |
| 67145 | 4/1982 | Japan | 75/242 |
| 58-245 | 4/1983 | Japan | 75/242 |

OTHER PUBLICATIONS

*IBM Tech. Disc. Bulletin,* by R. Travieso, vol. 25, No. 8, Jan. 1983, pp. 4270.

*Primary Examiner*—Paul T. Sewell
*Attorney, Agent, or Firm*—Robert E. Walter

[57] ABSTRACT

A print wire for a printer wire assembly consisting essentially of a very fine and uniform grain size tungsten carbide in a cobalt matrix results in a wire having improved strength.

10 Claims, No Drawings

PRINTER WIRE

This application is a continuation of application Ser. No. 584,847 filed July 24, 1985.

BACKGROUND OF THE INVENTION

This invention relates to a printer wire for printer wire assembly used in dot matrix printers.

Dot matrix printers have the capability of high speed printing and are useful, for example, in producing computer print-outs. Characters such as letters and numerals are formed by an array of dots printed on the print-out sheet by selective electronic activation of an array of printer wires.

The printer wires are fabricated from a material such as tungsten, tungsten-rhenium alloy or tungsten carbide and each is supported by a steel pin or armature. The armature has a socket for receiving the base portion of a wire.

Printer wires made from various steel alloys are used in some low speed printing applications since steel wires have low wear resistance they have not been used for the higher speed printing applications. Tungsten and its alloys have better wear resistance than steel but are not sufficiently strong for high speed, long life, printing applications. It is desirable to develop improved printer wires that are resistant to fracture and have high abrasion resistance, since even an occasional breakage of a printer wire can result in considerable expense and inconvenience. The downtime of a printer delays work in progress and necessitates expensive repair.

SUMMARY OF THE INVENTION

Manufacturers of high speed impact printers are continually striving to improve the reliability of the printers. Tungsten carbide printer wires for matrix printing machines are commonly made from tungsten carbide-cobalt alloys having a small grain size. When physical properties are measured on such a composition, the hardness is usually about 88.0 Ra and the transverse rupture strength after hot isostatic pressing is about 550,000 psi on test bars using ASTM B406-76 standard method of test. Since transverse rupture strength is usually a function of cross sectional area for cemented carbide, it has been found that the strength of a matrix printer wire made from the same material is about 600,000 psi.

The coercive force of a printer wire is determined by placing a wire into a measuring coil magnetized to saturation to provide a magnetic field which is detected by field sendors. Then an increasing opposing field is created until the field produced by the sample reaches zero. At this instance, the induction is zero and the field in the coil is the coercive force (Hc) of the sample. Typically the coercive force of prior printer wires is from 100 to 135 oersteds.

The purpose of this invention is to provide an improved tungsten carbide impact printer wire, said improvement consisting of finer and more uniform grain size printer wire which has higher resistance to breakage.

In accordance with the present invention, there is provided a print wire consisting essentially of from about 15 to about 30% by weight cobalt, from about 0.05 to about 5 weight percent additives including grain growth inhibitors, less than about 1% impurities and the remainder being tungsten carbide, said tungsten carbide comprising a uniformly very fine grain size of less than one micron being uniformly distributed throughout a matrix comprising cobalt.

The coercive force of the print wire of the present invention is typically higher than previous printer wires having similar cobalt content. In the present invention, the coercive force varies inversly with cobalt content. In other words, increasing the cobalt content decreases the coercive force. Preferably the coercive force varies from about 200 oersteds to 80 oersteds as the cobalt content varies from about 15 to about 30.

In accordance with the present invention there is also provided a print wire for a printer wire assembly consisting essentially of from about 17 to about 21 percent by weight cobalt, from about 2 to about 4 percent by weight molybdenum carbide, from about 0.05 to about 0.5 percent by weight vanadium carbide, and the remainder being tungsten carbide, wherein said tungsten carbide comprises a uniformly very fine grain size of less than one micron uniformly distributed throughout a matrix comprising cobalt resulting in improved strength.

DETAILED DESCRIPTION

The starting powders used in the compositions of the present invention should be in pure powder form. It is desirable to exclude impurities such as oxygen which tend to have deleterious effects on the density of the composition. Preferably the impurities should be less than about 1%. On the other hand, minor amounts of many intentional and unintentional additives can be tolerated with no appreciable loss of properties. Thus, the metal can contain small amounts of other metals such as titanium, zirconium, tantalum, or niobium as minor additives. Grain growth inhibitors such as vanadium carbide and molybdenum carbide preferably present as an intentional additive. Preferably such additives are from about 0.05 to about 5 percent by weight.

In preparing the compositions of the present invention, fine-grained starting materials are thoroughly milled to give a uniform mixture of starting materials. Preferably the metal carbide should be finely divided, having a particle size of less than about 1 micron and preferably less than about 0.8 microns. The starting mixture of metal carbide and metal binder particles is thoroughly mixed with an organic binder which permits subsequent extrusion of the milled mixture to a rod or wire form. The extruded rod or wire is sintered to a dense, pore free body by sintering. The sintering is typically formed in a vacuum at temperture from about d 1350 degrees to about 1475° C. for a period of time from about 1 to about 2 hours. The resulting densified bodies of the present invention have a fine average grain size of less than about 1 micron which is substantially the uniform throughout composition. The distribution of the metal carbide in the metal matrix is substantially uniform and homogeneous to result in a wire having high strength.

The starting powders are mixed and prepared in proportions necessary to give the desired composition resulting in the improved wire of the present invention. Tungsten carbide preferably has a grain size less than about 0.8 and even more preferably has a grain size of about 0.6. The grains should be uniform. The cobalt content is typically from about 16 to about 24 percent, preferably about 17 to about 21 percent by weight, and even more preferably about 19 percent by weight. The preferred coercive force corresponding to the above cobalt content is respectively about 192 to about 128; about 176 to about 128 and greater than about 160. Grain growth inhibitors are preferably present in an amount from about 0.5 to about 4 percent by weight. The molybdenum carbide content is preferably about 3 percent by weight and vanadium carbide content is preferably about 0.2 percent by weight. All weight percents are based on the total weight of the wire.

The following procedure is followed for preparing a wire. A fine powder tungsten carbide, cobalt mixture containing the appropriate amounts of intentional additives such as vanadium carbide and molybdenum carbide is milled in a ball mill for about 96 hours. After milling the powder is thoroughly and uniformly mixed with about 0.1 parts by weight of an extrudable organic wax binder. The organic binder and powder mixture is then extruded through an extruder to produce a green wire shape having a length of about 33 inches and a diameter of about 0.011 inch. The extruded wire is then sintered in a vacuum at about 1375 degrees for about 1.5 hours to give a printer wire which is cut to the appropriate length.

Following the above procedure, a wire having properties and composition of is 19.0 wt. % Co, 3.04 wt % $Mo_2C$, balance WC, and grain size of about 1 micron is prepared. When physical properties are measured on such a composition, it is found that the hardness is about 88.0 Ra, and the transverse rupture strength after hot isostatic pressing is about 550,000 psi on test bars, using ASTM B406 standard method of test.

Transverse rupture strength is usually a function of cross sectional area for cemented carbide, and it is found that the strength of a matrix printer wire made from the same material is about 600,000 psi.

Strength levels of about 600,000 psi for carbide printer wires are considered to represent the best state-of-the-art technology. Such strength levels are not, however, totally adequate for printer wire applications and wires occasionally fail in service.

A printer wire is made following the above procedures and having a composition of the present invention with improved strength and hardness by producing using a finer and more uniform grain size. This can be achieved, for instance, by employing a finer and more uniform tungstate carbide powder in the starting formulation and restricting grain growth during sintering by using various grain growth inhibitors.

As an example, a print wire composition was made in powder form using 19.0 percent cobalt, 3.04 percent molybdenum carbide balance tungsten carbide where the tungsten carbide powder was uniform and of about 0.6 micron particle size. The tungsten carbide also contained 0.2 percent vanadium carbide to act as a grain growth inhibitor. After sintering and hot isostatic pressing of test bars from this composition, it was found that the hardness was 88.9 Ra, and the strength was 632,000 psi. The grain structure has found to be very fine and uniform and of about 0.6 microns in size. These values of hardness and strength were higher than that of the standard print wire composition with grain sizes of about 1 micron.

Print wires were fabricated from this powder using the same procedures employed for standard print wires, and it was found that the strength of the new print wires was 687,000 psi. This strength was higher than any previously measured print wire. Whereas a standard print wire of 0.011"dia×3.76"length and with a strength of about 600,000 psi can be bent about 90° before breaking, the new print wire can be sent 180° before breaking.

I claim:

1. A print wire for a printer wire assembly connsisting essentially of from about 17 to about 21 percent by weight cobalt, from about 2 to about 4 percent by weight molybdenum carbide, from about 0.05 to about 0.15 percent by weight vanadium carbide, and the remainder being tungsten carbide, wherein said tungsten carbide comprises a uniformly fine grain size of less than one micron uniformly distributed throughout a matrix comprising cobalt resulting in improved strength.

2. A print wire for a printer wire assembly according to claim 1 wherein said improved strength as determined by using the ASTM B406-76 standard test method results in test bars having a strength exceeding 600,000 psi.

3. A print wire for a printer wire assembly according to claim 1 wherein said wire has a diameter of about 0.011 inch and a length of about 3.76 inches and said improved strength of said wire is greater than 650,000 psi.

4. A print wire for a printer wire assembly according to claim 3 wherein said wire can be sent through an arc of about 180 degrees prior to breaking.

5. A print wire for a printer wire assembly according to claim 1 wherein said tungsten carbide has a grain size of less than about 0.8 microns.

6. A print wire for a printer wire assembly according to claim 5 wherein said tungsten carbide has a grain size of about 0.6 microns.

7. A print wire for a priner wire assembly according to claim 5 wherein said wire consists essentially of about 3 percent by weight molybdenum carbide, about 0.2 percent by weight vanadium carbide and about 17 to about 21 percent by weight cobalt.

8. A print wire for a printer wire assembly according to claim 7 wherein said wire consists essentially of about 19 percent by weight cobalt.

9. A print wire for a printer wire assembly according to claim 8 wherein said improved strength as determined by using the ASTM B406-76 standard test method results in test bars having a strength exceeding 600,000 psi.

10. A print wire for a printer wire assembly according to claim 8 wherein said wire has a diameter of about 0.011 inch and a length of about 3.76 inches and said improved strength of said wire is greater than 650,000 psi.

* * * * *